United States Patent [19]

Ross et al.

[11] 4,298,450

[45] Nov. 3, 1981

[54] ALCOHOLS AS HYDROGEN-DONOR SOLVENTS FOR TREATMENT OF COAL

[75] Inventors: David S. Ross, Palo Alto; James E. Blessing, Menlo Park, both of Calif.

[73] Assignee: The United States of America as represented by the United States Department of Energy, Washington, D.C.

[21] Appl. No.: 857,717

[22] Filed: Dec. 5, 1977

[51] Int. Cl.[3] ..... C10G 1/00; C10G 1/06

[52] U.S. Cl. ..... 208/8 LE; 208/10; 208/9

[58] Field of Search ..... 208/8, 10, 9

[56] References Cited

U.S. PATENT DOCUMENTS

| | | | |
|---|---|---|---|
| 1,437,775 | 12/1922 | Plauson | 208/8 |
| 2,133,280 | 10/1938 | Burk | 208/8 |
| 2,202,901 | 6/1940 | Dreyfus | 208/8 |
| 2,605,212 | 7/1952 | Lobban | 208/263 |
| 3,117,921 | 1/1964 | Gorin | 208/8 |
| 3,976,438 | 8/1976 | Bay | 208/8 |
| 3,983,027 | 9/1976 | McCollum et al. | 208/8 |
| 4,030,893 | 6/1977 | Keller | 208/8 |
| 4,051,012 | 9/1977 | Plumlee | 208/8 |
| 4,124,485 | 11/1978 | Can et al. | 208/10 X |

FOREIGN PATENT DOCUMENTS

| | | | |
|---|---|---|---|
| 156695 | 3/1922 | United Kingdom | 208/8 |

OTHER PUBLICATIONS

Brewster, *Organic Chemistry,* 1953, pp. 144–145.

Ross et al., FE-2202-9 Quarterly Rpt . #3 for May 1, 1976–Jul. 31, 1976, Homogeneous Catalytic Hydrocracking Processes for Conversion of Coal to Liquid Fuels, Basic & Exploratory Res. 8-15-76, pp. 23-35, Hawley, ed., Condensed Chemical Dictionary, 1977, p. 149.

*Primary Examiner*—Delbert E. Gantz
*Assistant Examiner*—William G. Wright
*Attorney, Agent, or Firm*—Irene S. Croft; Roger S. Gaither; James E. Denny

[57] ABSTRACT

A method for the hydroconversion of coal by solvent treatment at elevated temperatures and pressure wherein an alcohol having an α-hydrogen atom, particularly a secondary alcohol such as isopropanol, is utilized as a hydrogen donor solvent. In a particular embodiment, a base capable of providing a catalytically effective amount of the corresponding alcoholate anion under the solvent treatment conditions is added to catalyze the alcohol-coal reaction.

8 Claims, No Drawings

ALCOHOLS AS HYDROGEN-DONOR SOLVENTS FOR TREATMENT OF COAL

BACKGROUND OF THE INVENTION

This invention was made in the course of or under Contract No. EF-76-C-01-2202 with the United States Department of Energy.

This invention relates to hydroconversion of coal, particularly by means of treatment with a hydrogen-donor solvent.

Solvent refining or solvent extraction of coal involves treating pulverized coal with a suitable solvent, with or without the addition of hydrogen, at elevated temperatures and pressure to promote dissolution of the coal by hydrogen-donor activity and provide a coal extract, liquid under the conditions of extraction, and undissolved coal residue. Most of the ash and sulfur in the feed coal is recovered with the residue. The hydrogen-enriched coal extract can be used directly as boiler fuel or it may be used as a precursor to distillate fuels. Solvent extraction can be combined with a hydrogenation process to produce syncrude. Various extractive conversion processes are described in C. K. Goldman, *Liquid Fuels From Coal, Chemical Process Review No.* 57, Noyes Data Corporation, Park Ridge, N.J., 1972.

In general, all prior art processes use partially or completely hydrogenated aromatics such as tetralin, decalin, biphenyl and methylnaphthalene. Mixtures of these hydrocarbons are normally employed and are derived from intermediate or final steps of the coal conversion process.

SUMMARY OF THE INVENTION

In accordance with the present invention, it has been found that alcohols having an α-hydrogen atom can be used as hydrogen-donor solvents in the solvent treatment of coal. The preferred solvents for use in the present invention are the secondary alcohols, particularly secondary alkyl alcohols such as isopropanol. Other suitable solvents include methanol, secondary butyl alcohol, normal propanol and the like.

It has also been found that the reaction of the alcohol solvent and the coal is catalyzed by the presence of a base capable of providing a catalytically effective amount of the corresponding alcoholate anion under the solvent treating conditions, for example, an alkali metal hydroxide.

It is, therefore, an object of this invention to provide a method for the hydroconversion of coal.

More particularly, it is an object of this invention to provide a method for the hydroconversion of coal by solvent treatment with a hydrogen donor solvent.

Other objects and advantages will become apparent from the following detailed description.

DESCRIPTION OF THE PREFERRED EMBODIMENTS

Broadly, the process of the present invention comprises treating coal with an alcohol having an α-hydrogen atom under conditions to promote dissolution of the coal in the alcohol by hydrogen donor activity with formation of a coal extract, liquid under the conditions of extraction, and an undissolved coal residue. In a particular embodiment of the invention, a base capable of providing a catalytically effective amount of the corresponding alcoholate anion under the conditions of coal dissolution is added to catalyze the reaction.

The following chain process, wherein R and R′ represent hydrogen or an organic radical, particularly an alkyl radical, is proposed as the mechanism for the net transfer of $H_2$ to the coal:

$$^{-}OCHRR' + coal \rightarrow O{=}CRR' + coalH^{-} \quad (1)$$

$$coalH^{-} + HOCHRR' \rightarrow coalH_2 + {}^{-}OCHRR' \quad (2)$$

in which the alcoholate ion is regenerated with each cycle, $H_2$ has been transferred to the coal, and an aldehyde or ketone is formed.

The above reaction is catalyzed by the addition of the alcoholate anion to the system, or by the addition of another suitable catalyst, such as an alkali metal hydroxide, which forms significant amounts of the alcoholate anion under the coal conversion conditions, that is, the equilibrium $$OH^{-} + HOCHRR' \rightleftharpoons H_2O + {}^{-}OCHRR' \quad (3)$$

lies significantly to the right under coal conversion conditions.

EXAMPLES 1-11

The experiments hereinafter described are illustrative of the process of the present invention. The experiments were carried out in a 300 ml MagneDrive, stainless steel autoclave from Autoclave Engineers. The substrate was beneficiated Illinois No. 6 coal supplied by Pennsylvania State University (PSOC 26), and ground under nitrogen in a ball mill to −60 mesh. In each run, 5-g samples of the coal were used, in addition to 75 to 150 g of alcohol solvent. The experiments were run at 335° C. with typically 45 min heat-up and 60 min cool-down periods. No hydrogen was used in the experiments, except in Run 95, and the pressures are those generated by the solvents themselves. The reaction temperature of 335° C. was above the critical temperatures of the alcohols used.

In the experiments, the product mixture was filtered, the residue washed with more solvent until the washings were colorless, and the filtrate recovered by evaporation of the solvent under vacuum. For those cases in which alkoxide salts were used, all fractions were appropriately neutralized with concentrated HCl and the salts removed. Both the filtrate and the residue were then dried to constant weight at 110° C. under <1 torr pressure. Mass balances were generally greater than 95%. In all cases the isolated filtrate was found to be fully pyridine-soluble. Pyridine solubilities of the residues were determined at room temperature, with 0.5 g of a product coal fraction stirred at room temperature for 1 hour in 50 ml pyridine. The pyridine solubilities of the residues were established for all cases and recorded as the percent of the residue soluble in pyridine. For some cases, it was convenient to refer to the composite pyridine solubilities and elemental composition values, that is, these values for the entire coal sample. In these instances the individual values for both the filtrates and residues were appropriately summed and recorded.

For purposes of comparison, runs were made with tertiary butyl alcohol (Run 36), potassium t-butoxide/t-butanol (Run 61), and tetralin (Run 48), and hydrogen was added in Run 95.

The results of the experiments are summarized in Table I.

ILLINOIS NO. 6 COAL AND ISOPRPYL ALCOHOL SYSTEMS AT $\rho = 0.32$ AND 335° C. (635° F.)

| RUN | SOLVENT SYSTEM | REACTION TIME (MIN) | REACTION PRESSURE (PSIG) | REACTION PRODUCTS % FILT[a] | % PS[b] | MOLAR H/C[c] | % S[c] | % N[c] | % ASH[c] | MASS BALANCE (%) |
|---|---|---|---|---|---|---|---|---|---|---|
| — | Untreated Coal, Dried | — | — | — | 13 | 0.78 | 2.1 | 1.7 | 2 | — |
| 38 | i-PrOH | 90 | 1800 | 11 | 40 | 0.82 | 2.1 | 2.1 | — | 97 |
| 62 | i-PrOH + 0.5 g KOiPr | 90 | 1900 | 19 | 89 | 0.85 | 1.5 | 1.5 | 0 | 92 |
| 54 | i-PrOH + 1.0 g KOiPr | 90 | 2000 | 40 | 97 | 0.95 | 0.4 | 1.7 | 6 | 96 |
| 94 | i-PrOH + 1.0 g KOiPr | 90 | 1800 | — | >96 | 0.89 | 1.5 | 1.5 | 3 | 92 |
| 92 | i-PrOH + 1.0 g KOiPr | 30 | 1800 | 9 | 17 | 0.79 | 1.9 | 1.6 | 3 | 100 |
| 95 | i-PrOH + g KOiPr + $H_2$[d] | 90 | 4000 | 14 | 92 | 0.90 | 1.5 | 1.4 | 3 | 94 |
| 97 | i-PrOH + 1.0 $CaCO_3$ | 90 | 1800 | 10 | 30 | 0.84 | 1.9 | 1.6 | 4 | 96 |
| 98 | i-PrOH + 0.6 g KOH | 90 | 1900 | 11 | 96 | 0.87 | 1.6 | 1.6 | 3 | 103 |
| 36 | tBuOH ($\rho = 0.2$) | 90 | ~2000 | — | 13 | — | — | — | — | — |
| 61 | tBuOH + K(OtBu) ($\rho = 0.5$) | 90 | ~2000 | — | 12 | — | — | — | — | — |
| 48 | Tetralin[e] | 90 | ~2000 | — | 47 | 0.81 | 1.83 | 1.58 | — | — |

[a]Filtrate ≡ material dissolved in i-PrOH after reaction, ash free basis.
[b]PS ≡ material soluble in pyridine, including "Filt", ash free basis.
[c]Composite of values for both filt and residue.
[d]1000 psig of $H_2$ at room temperature.
[e]The critical temperature of Tetralin is 484 ± 32° C. Thus the medium here was subcritical It can be seen from Table I that treatment of the coal with isopropyl alcohol (Run 38) results in a product coal which displays a solubility in pyridine of 40%, whereas untreated coal has a pyridine solubility of only 13%. The results obtained with isopropyl alcohol are comparable to those obtained for a similar experiment with tetralin (Run 48) where the resultant coal product shows a 47% pyridine solubility. The similarity of the elemental analyses for the products in both cases indicates that isopropyl alcohol, like tetralin, acts as an H-donor solvent under the above conditions.

It is shown in Table I that pyridine solubility is substantially enhanced, to >96%, by the addition of the isopropoxide anion (Runs 62, 54, and 94). $CaCO_3$ and KOH were used in Runs 97 and 98 respectively. The $CaCO_3$ system was not catalytically effective, but the KOH system was substantially as effective as potassium isopropoxide (Run 94). Thus the equilibrium $$OH^- + HOCH(CH_3)_2 \rightleftharpoons H_2O + {}^-OCH(CH_3)_2 \quad (4)$$

must lie significantly to the right under the conditions described.

Runs 36 and 61, using a tertiary alcohol, t-butyl alcohol, which does not have an α-hydrogen, resulted in a product coal having a pyridine solubility substantially the same as untreated coal.

It was also found that reaction product yields decreased when the reaction time was reduced from 90 min to 30 min (Run 92).

In Run 95, wherein hydrogen was added, the H/C value and the pyridine solubility are comparable with those for Run 94, indicating that the addition of $H_2$ has little effect on the process.

While the exact mechanism of reaction between the coal and the alcohol solvent is not precisely known, the results of the above-described experiments suggest the following chain process for the reaction of coal with isopropanol or isopropoxide anion:

$$^-OCH(CH_3)_2 + coal \rightarrow coalH^- + O{=}C(CH_3)_2 \quad (5)$$

$$coalH^- + HOCH(CH_3)_2 \rightarrow coalH_2 + {}^-OCH(CH_3)_2 \quad (6)$$

where the net reaction is the transfer of $H_2$ to the coal and the formation of acetone. Acetone was, in fact, found in the reaction solvents by gas chromatography after reaction.

Although specific operating conditions are given in the above-described experiments, operating conditions may be varied widely, depending upon the particular alcohol solvent used. It is preferred that the temperature be at least 300° C., preferably in the range of 300°–500° C., with a residence time of more than 30 minutes. Operating conditions should be chosen so as to maintain the solvent and dissolved coal in substantially liquid form during the conversion process.

Additional details concerning the present invention can be found in the technical reports *Homogeneous Catalytic Hydrocracking Processes for Conversion of Coal to Liquid Fuels: Basic and Exploratory Research,* FE-2202-3 Quarterly Report No. 3 Covering the Period May 1, 1976, through July 31, 1976, and FE-2202-18 Quarterly Report No. 5 Covering the Period November 1, 1976—Jan. 31, 1977, Stanford Research Institute, which reports are available from the National Technical Information Service, U.S. Department of Commerce, Springfield, Va. 22161.

The present invention can be used in solvent refining or solvent extraction processes, such as are described in the above-cited Goldman reference, as a replacement for the tetralin-based recycle solvents currently used for the production of synthetic liquid fuels. The solvent media of the present invention, particularly isopropyl alcohol, have the advantage of relatively low boiling points and reaction temperatures, low viscosity, and water solubility.

Furthermore, unlike the case with tetralin-based recycle solvents, the hydrogen donor process using the solvent media of the present invention is capable of being catalyzed, permitting operation at lower temperatures than in conventional systems.

Although the invention has been described with reference to specific examples, various modifications and changes, within the scope of the invention, will be apparent to those skilled in the art and are contemplated to be embraced within the invention.

What we claim is:

1. In a method for the hydroconversion of coal by solvent treatment with a hydrogen-donor solvent under conditions to promote hydroconversion of the coal by hydrogen transfer activity, the improvement comprising utilizing as the hydrogen-donor solvent an alcohol having an α-hydrogen atom, and carrying out the solvent treatment step in the presence of a base capable of providing a catalytically effective amount of the corresponding alcoholate anion under the hydroconversion conditions.

2. A method according to claim 1 wherein the solvent treatment is carried out at a temperature of at least 300° C.

3. A method according to claim 1 wherein the base is an alkali metal hydroxide.

4. A method according to claim 1 wherein the alcohol is a secondary alcohol.

5. A method according to claim 4 wherein the alcohol is a secondary alkyl alcohol.

6. A method according to claim 5 wherein the alcohol is isopropyl alcohol.

7. A method according to claim 6 wherein the base is potassium isopropoxide.

8. A method according to claim 6 wherein the base is potassium hydroxide.

* * * * *